US007688173B2

(12) United States Patent
Azuma et al.

(10) Patent No.: US 7,688,173 B2
(45) Date of Patent: Mar. 30, 2010

(54) COMMON MODE CHOKE COIL

(75) Inventors: Takahiro Azuma, Yokohama (JP); Yoshie Nishikawa, Kowloon (HK); Takahiro Aoki, Moriyama (JP); Yoshimasa Goto, Sagamihara (JP); Yasushi Saito, Sagamihara (JP); Shinya Hirai, Kusatsu (JP); Yu Ishiwata, Yasu (JP); Tetsuya Morinaga, Yasu (JP)

(73) Assignee: Murata Manufactoring Co., Ltd., Kyoto (JP)

( * ) Notice: Subject to any disclaimer, the term of this patent is extended or adjusted under 35 U.S.C. 154(b) by 0 days.

(21) Appl. No.: 12/425,561

(22) Filed: Apr. 17, 2009

(65) Prior Publication Data

US 2009/0195342 A1 Aug. 6, 2009

Related U.S. Application Data

(63) Continuation of application No. PCT/JP2007/070244, filed on Oct. 17, 2007.

(30) Foreign Application Priority Data

Dec. 1, 2006 (JP) ..... 2006-325507

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS

| | | | | |
|---|---|---|---|---|
| 6,242,996 | B1 | 6/2001 | Sato et al. | |
| 6,348,850 | B1 * | 2/2002 | Kimura et al. | 336/200 |
| 6,373,366 | B1 | 4/2002 | Sato et al. | |
| 6,472,969 | B1 * | 10/2002 | Hanato | 336/200 |
| 6,717,500 | B2 * | 4/2004 | Girbachi et al. | 336/83 |
| 7,312,682 | B2 * | 12/2007 | Yasuda et al. | 336/200 |
| 2002/0084878 | A1 * | 7/2002 | Kimura et al. | 336/83 |
| 2003/0071704 | A1 | 4/2003 | Toi et al. | |
| 2006/0071749 | A1 * | 4/2006 | Aoki et al. | 336/83 |

FOREIGN PATENT DOCUMENTS

| | | | |
|---|---|---|---|
| JP | 3-252108 | A | 11/1991 |
| JP | 2000-133522 | A | 5/2000 |
| JP | 2001-93756 | A | 4/2001 |
| JP | 2003-168611 | A | 6/2003 |
| JP | 2005-322820 | A | 11/2005 |
| JP | 2006-73958 | A | 3/2006 |

OTHER PUBLICATIONS

Official Communication issued in International Patent Application No. PCT/JP2007/070244, mailed on Jan. 29, 2008.

* cited by examiner

*Primary Examiner*—Anh T Mai
(74) *Attorney, Agent, or Firm*—Keating & Bennett, LLP

(57) ABSTRACT

A common mode choke coil includes a core, external electrodes, a pair of windings, and a top plate. The core includes a winding core portion and a pair of flanges disposed at respective ends thereof. The external electrodes are provided at lower portions of the flanges. The pair of the windings is wound around the winding core portion of the core, and ends thereof are connected to the external electrodes, respectively. A lower surface and a side surface of the top plate are covered with a metal film and are adhered to upper surfaces of the flanges with an adhesive. Preferably, magnetic powder is mixed in the adhesive.

5 Claims, 9 Drawing Sheets

COMMON MODE CHOKE COIL

BACKGROUND OF THE INVENTION

1. Field of the Invention

The present invention relates to wire-wound common mode choke coils for eliminating common mode noises on transmission paths.

2. Description of the Related Art

Conventional common mode choke coils of this type are disclosed in Japanese Unexamined Patent Application Publication No. 2003-168611 and Japanese Unexamined Patent Application Publication No. 2000-133522.

A common mode choke coil of this type has a configuration in which two wires are wound around a winding core potion of a core having flanges on respective sides, ends of each of the wires are connected to electrodes provided at the flanges on the respective sides, and a ferrite plate is arranged on an upper surface side of the flanges.

With this configuration, it is possible to eliminate common mode noises in differential transmission paths of a CAN (Controller Area Network) or the like.

However, the above-described conventional common mode choke coils have a problem as described below.

In general, an immunity test is performed before products are put on the market to examine whether the products can tolerate various kinds of electromagnetic interference by exposing the products to expected electromagnetic interference.

In the immunity test of a common mode choke coil against common mode noises, a common mode choke coil defining a test-target product is arranged upstream of a reception IC, which is connected to a transmission IC through differential transmission paths. Differential signals are transmitted from the transmission IC to the reception IC through the differential transmission paths and common mode noises of, for example, 1 MHz to 400 MHz are generated on the differential transmission paths, whereby these common mode noises are superposed on the differential signals. In such a state, the transmission IC or the reception IC malfunctions is checked to determine whether it malfunctions.

However, since the inductance of the common mode choke coil defining the test-target product and the input capacitance of the reception IC define a resonant circuit at the time of such an immunity test, a ratio of suppressing common mode noises drops at a resonant frequency of this resonant circuit and a frequency band near the resonant frequency. In such a case, the transmission IC or the reception IC malfunctions and a problem in that the test-target product does not pass the immunity test occurs.

SUMMARY OF THE INVENTION

To overcome the problems described above, preferred embodiments of the present invention provide a common mode choke coil that improves an immunity characteristic by providing a coil having a structure that is capable of preventing malfunctions of the transmission IC and the reception IC at the time of an immunity test.

A common mode choke coil according to a preferred embodiment of the present invention includes a magnetic core having a winding core portion and a pair of flanges provided at respective ends of the winding core portion, external electrodes provided on the respective flanges, a pair of windings wound around the winding core portion, each end of the pair of the windings being extended and connected to the external electrode, and a magnetic plate attached to the pair of the flanges with an adhesive. A metal film is provided at least on a contact portion of the magnetic plate contacting the flanges, in addition to the external electrodes.

With such a configuration, the metal film is preferably provided at least on the contact portion of the magnetic plate contacting the flanges. Accordingly, a noise resistance component of a resonant frequency of a resonant circuit, defined by an inductance of the common mode choke coil and a capacitor of an input unit of a reception IC, and a noise resistance component in a frequency band near the resonant frequency increases at the time of an immunity test and the common mode noises are suppressed.

The magnetic core and the magnetic plate of the common mode choke coil are preferably made of ferrite.

With such a configuration, a magnetic characteristic can be improved.

The metal film is preferably made of a ferromagnetic material including at least one of iron, cobalt, nickel, chromium, manganese, and copper, for example.

With such a configuration, a noise resistance component can be further increased while maintaining a preferable magnetic characteristic.

Alternatively, the metal film may preferably be made of an alloy of ferromagnetic materials including nichrome as a main component.

Preferably, magnetic powder is mixed into the adhesive.

With such a configuration, a magnetic characteristic can be further improved.

As described in detail above, since a metal film is preferably provided at least on a contact portion of a magnetic plate contacting flanges, the immunity characteristic is improved in accordance with a common mode choke coil according to a preferred embodiment of the present invention. As a result, a superior advantage of providing a preferable noise suppression effect against noises of all frequency bands in an immunity test is provided.

In addition, according to a preferred embodiment of the present invention, improved magnetic characteristics of the coil are provided.

Furthermore, according to a preferred embodiment of the present invention, a further increase in a resistance component against noises is provided.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described below with reference to the drawings.

First Preferred Embodiment

Figure 1:
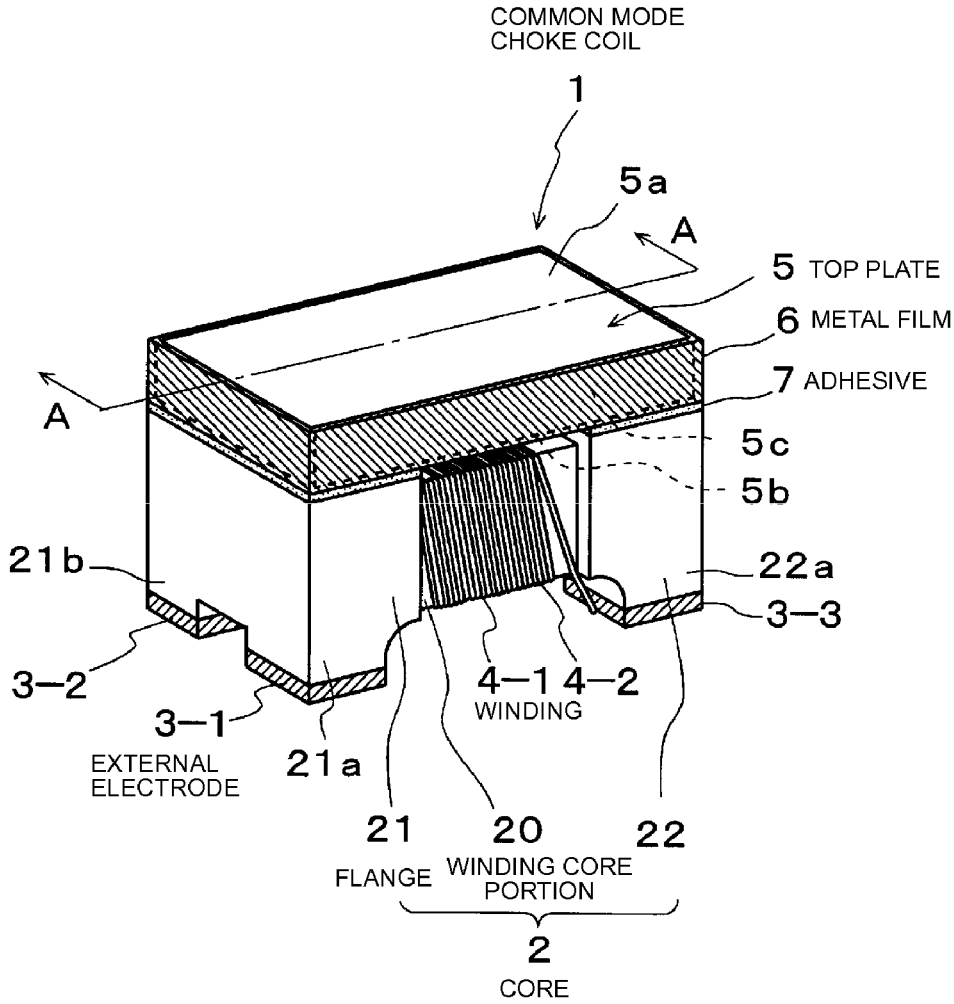
FIG. 1 is a perspective view showing a common mode choke coil according to a first preferred embodiment of the present invention.
Figure 2:
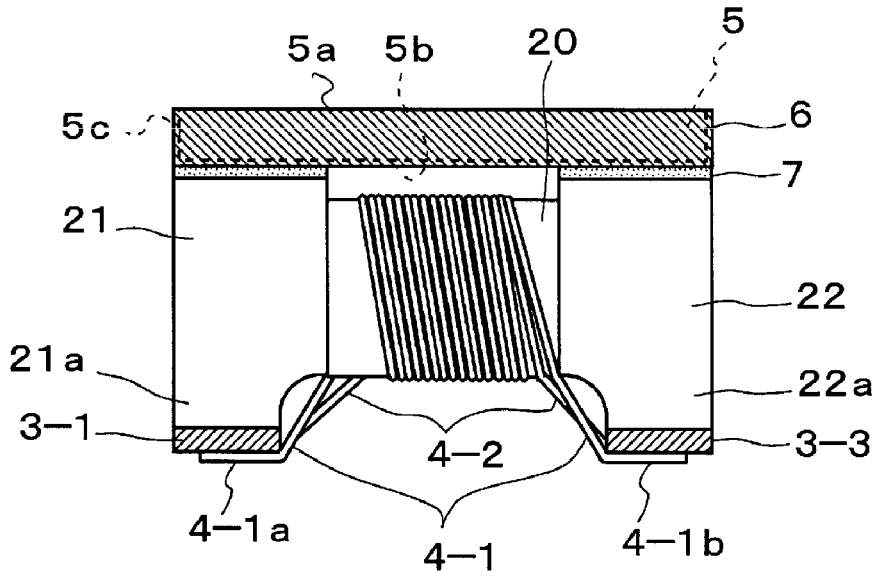
FIG. 2 is an elevational view of the common mode choke coil shown in FIG. 1.
Figure 3:
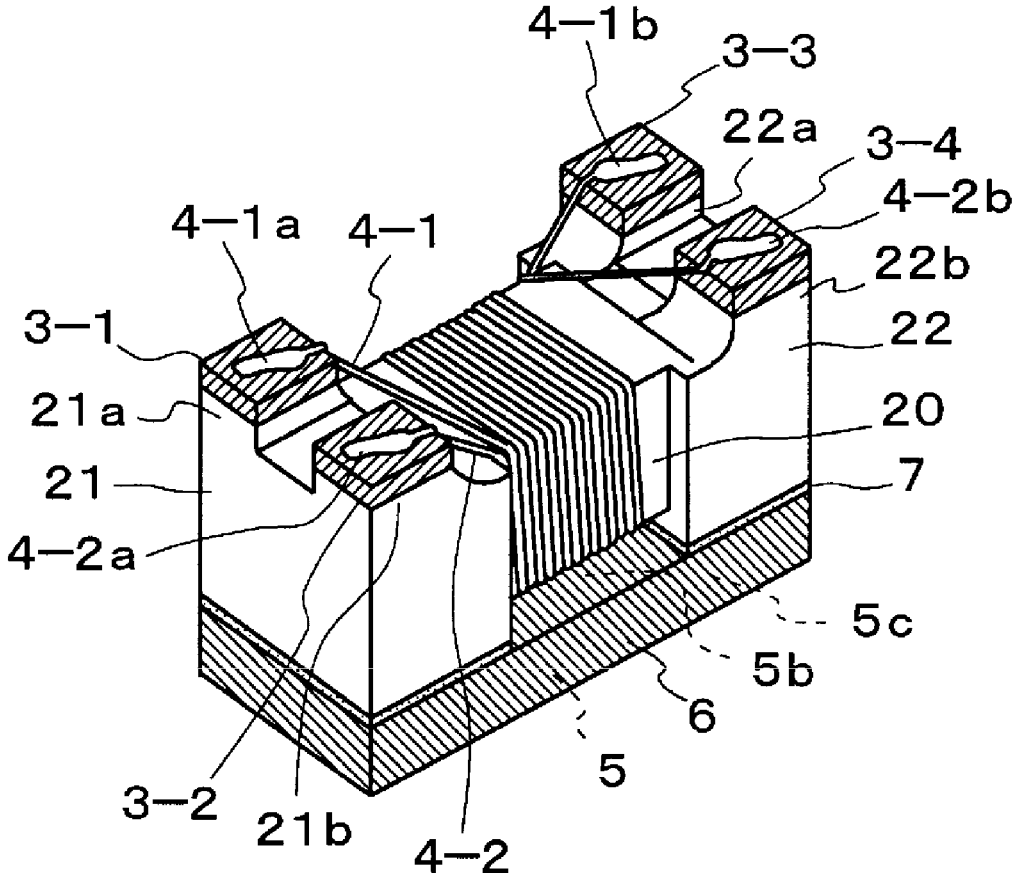
FIG. 3 is a perspective view showing a bottom surface of the common mode choke coil shown in FIG. 1.

FIG. 1 is a perspective view showing a common mode choke coil according to a first preferred embodiment of the present invention. FIG. 2 is an elevational view of the common mode choke coil of the first preferred embodiment, whereas FIG. 3 is a perspective view showing a bottom surface of the common mode choke coil of the first preferred embodiment.

As shown in FIG. 1 and FIG. 2, a common mode choke coil 1 is a surface-mount-type wire-wound coil and includes a core 2 that defines a magnetic core, four external electrodes 3-1 to 3-4, a pair of windings 4-1 and 4-2, and a top plate 5 that defines a magnetic plate.

The core 2 is preferably made of ferrite, such as Mn—Zn based ferrite or Ni—Zn based ferrite, for example. The core includes a winding core portion 20 arranged at a central portion, and a pair of flanges 21 and 22 arranged at respective ends thereof.

The external electrodes 3-1 to 3-4 are provided on lower portions the flanges 21 and 22.

More specifically, as shown in FIG. 3, the external electrodes 3-1 and 3-2 are provided on legs 21*a* and 21*b* of the flange 21, respectively, whereas the external electrodes 3-3 and 3-4 are provided on legs 22*a* and 22*b* of the flange 22, respectively.

The pair of windings 4-1 and 4-2 is preferably copper wires covered with an insulating film and is wound around the winding core portion 20 of the core 2. Ends 4-1*a* and 4-2*a* of the windings 4-1 and 4-2 are extended to sides of the external electrodes 3-1 and 3-2 and are connected to the external electrodes 3-1 and 3-2, respectively. Ends 4-1*b* and 4-2*b* of the windings 4-1 and 4-2 are extended to sides of the external electrodes 3-3 and 3-4 and are connected to the external electrodes 3-3 and 3-4, respectively.

Similar to the core 2, the top plate 5 shown in FIG. 1 is also preferably made of ferrite, such as Mn—Zn based ferrite and Ni—Zn based ferrite, for example. A lower surface 5*b* and a side surface 5*c*, but not an upper surface 5*a*, thereof are covered with the metal film 6.

The metal film 6 is preferably made of a ferromagnetic material including at least one of iron, cobalt, nickel, chromium, manganese, and copper, for example. However, the metal film is preferably made of a ferromagnetic material including nichrome as a main constituent. In addition, the thickness of the metal film 6 is preferably in a range of about 0.3 μm to about 5 μm, and more preferably in a range of about 0.5 μm to about 3 μm, for example.

The top plate 5 is arranged on upper surfaces of the flanges 21 and 22 and is attached to the upper surfaces of the flanges 21 and 22 with an adhesive 7, for example.

The adhesive 7 is preferably mixed with a magnetic powder. The adhesive not only connects the core 2 and the top plate 5 but also improves a magnetic characteristic therebetween.

Figure 4:
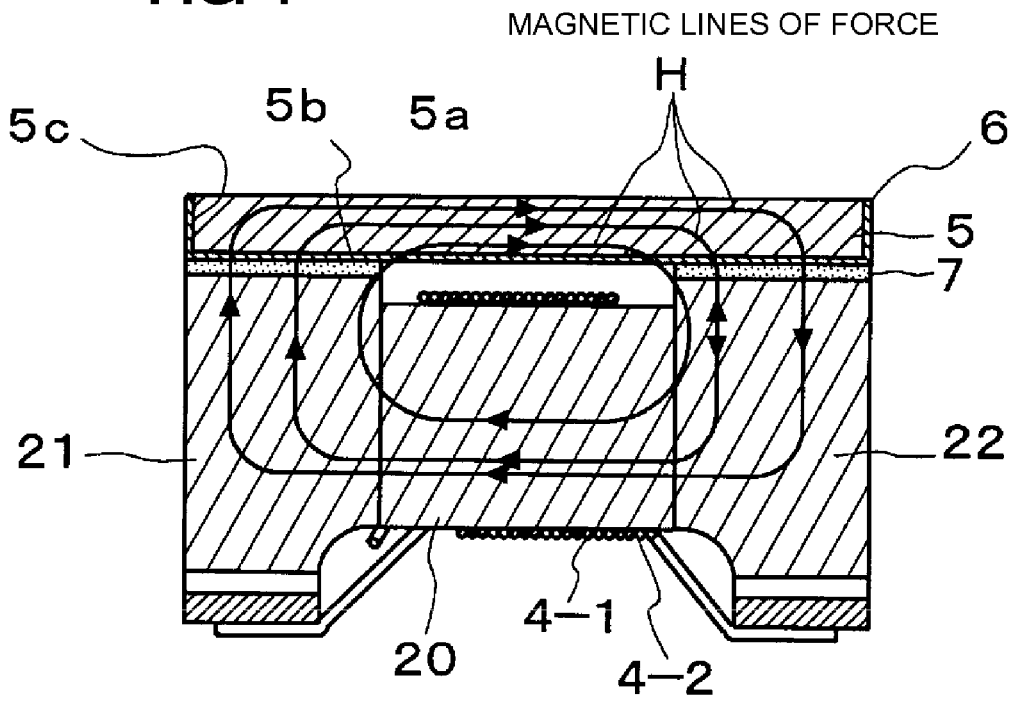
FIG. 4 is a sectional view taken along a line A-A of FIG. 1.

FIG. 4 is a sectional view taken along a line A-A of FIG. 1.

In the common mode choke coil 1, magnetic lines of force H corresponding to the signal are generated along the winding core portion 20, the flanges 21 and 22, and the top plate 5 in response to an input of a signal of a predetermined frequency to the common mode choke coil 1 as shown by arrows in FIG. 4.

At this time, since the metal film 6 is arranged at a portion through which the magnetic lines of force H pass, this metal film 6 functions as a resistance component of the common mode choke coil 1.

Figure 5A:
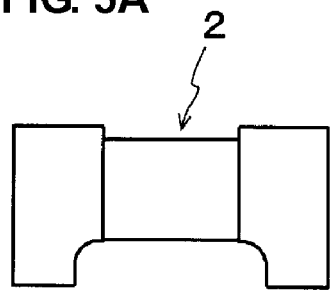
FIGS. 5A to 5D show a process diagram of a first process of a method for manufacturing a common mode choke coil according to a preferred embodiment of the present invention.
Figure 5B:
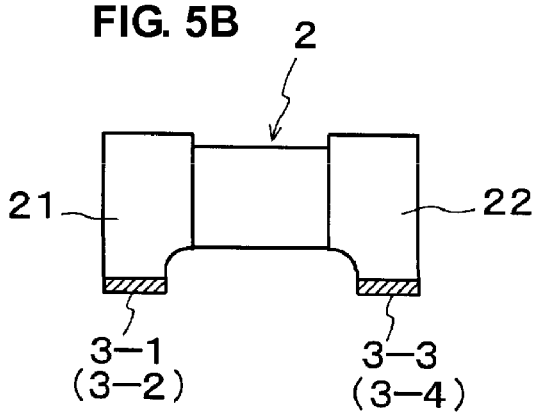
Figure 5C:
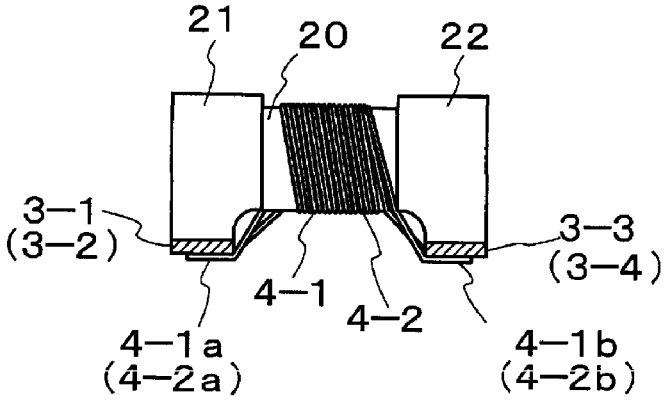
Figure 5D:
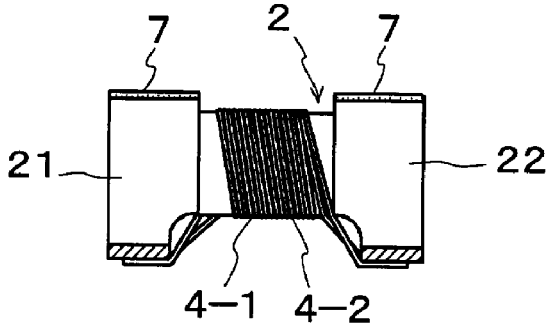
Figure 6A:
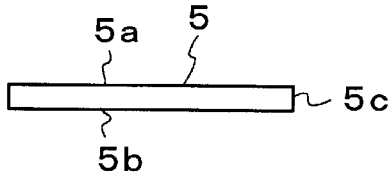
FIGS. 6A and 6B show a process diagram of a second process of a method for manufacturing a common mode choke coil according to a preferred embodiment of the present invention.
Figure 6B:
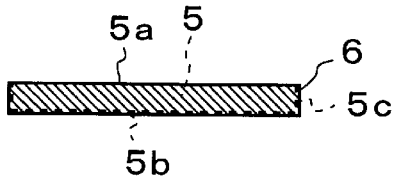

FIGS. 5A to 5D show a first process of a method for manufacturing the common mode choke coil 1, and FIGS. 6A and 6B show a second process of a method for manufacturing the common mode choke coil 1.

The first process is a process for manufacturing a common mode choke coil main body as shown in FIGS. 5A to 5D. More specifically, the external electrodes 3-1 to 3-4 are applied to lower portions of the flanges 21 and 22 of the core 2 as shown in FIG. 5B after the core 2 is formed as shown in FIG. 5A. The windings 4-1 and 4-2 are then wound around the winding core portion 20 of the core 2 as shown in FIG. 5C, the ends 4-1*a* and 4-2*a* and the ends 4-1*b* and 4-2*b* are connected to the external electrodes 3-1 and 3-2 and the external electrodes 3-3 and 3-4, respectively. After a predetermined time, as shown in FIG. 5D, the adhesive 7 is applied to the upper surfaces of the flanges 21 and 22.

The second process is a process for manufacturing the top plate 5 as shown in FIGS. 6A and 6B which is executed in parallel to the first process.

More specifically, the top plate 5 is formed as shown in FIG. 6A. The metal film 6 is then formed on the lower surface 5*b* and the side surface 5*c* of this top plate 5 in accordance with a method, such as metal plating, for example, as shown in FIG. 6B.

After the first and second processes are performed, the metal-film-6-attached top plate 5 produced in the second process is attached to the upper surfaces of the flanges 21 and 22 of the core 2 produced in the first process with the adhesive 7. In this manner, the common mode choke coil 1 is manufactured.

Figure 7:
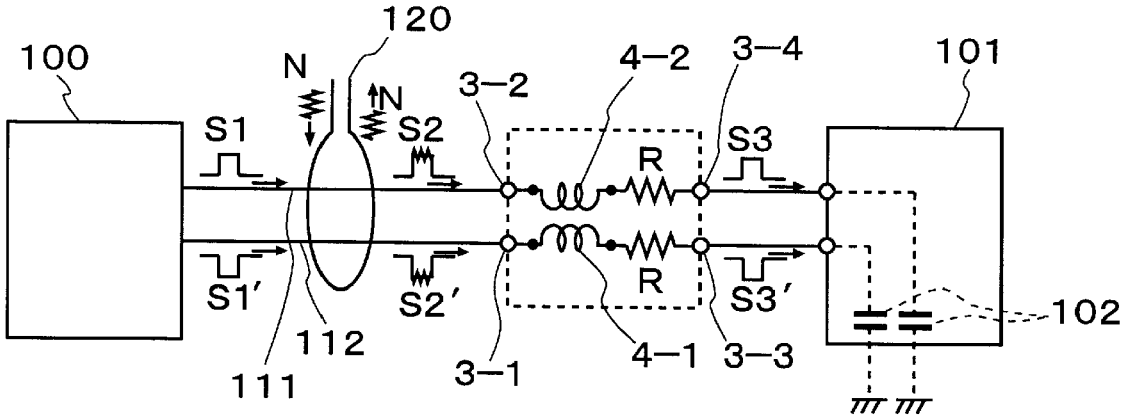
FIG. 7 is a schematic block diagram for illustrating effects and advantages of a common mode choke coil according to a preferred embodiment of the present invention in an immunity test.

FIG. 7 is a schematic block diagram illustrating the effects and advantages of the common mode choke coil 1 in an immunity test.

In FIG. 7, numerals 100 and 101 represent a transmission IC and a reception IC, respectively. The transmission IC 100 and the reception IC 101 are connected through differential transmission paths 111 and 112. A noise generator 120 for generating common mode noises N is arranged at portions of the differential transmission paths 111 and 112 near the transmission IC 100.

The common mode choke coil 1 is connected to portions of the differential transmission paths 111 and 112 near the reception IC 101. More specifically, the external electrodes 3-2 and 3-4 are connected to the differential transmission path 111, whereas the external electrodes 3-1 and 3-3 are connected to the differential transmission path 112.

In such a state, differential signals S1 and S1' are output from the transmission IC 100 to the differential transmission paths 111 and 112, respectively, and, at the same time, the common mode noises N in a predetermined frequency range are generated on the differential transmission paths 111 and 112 using the noise generator 120.

Differential signals S2 and S2', on which the common mode noises N are superposed, are transmitted toward the common mode choke coil 1 and are input to the common mode choke coil 1 through the external electrodes 3-1 and 3-2, respectively. These differential signals S2 and S2' then propagate through the windings 4-1 and 4-2 and the resistors R and R, and are output to the differential transmission paths 111 and 112 as differential signals S3 and S3' through the external electrodes 3-3 and 3-4, respectively.

Meanwhile, a capacitance at a terminal of the reception IC 101 is provided as a sum of many kinds of capacitances that are produced at the terminal. Herein, for ease of understanding, the capacitance is shown as a capacitor 102. Accordingly, since the capacitor 102 is provided at the terminal of the reception IC 101, an inductance defined by the windings 4-1 and 4-2 of the common mode choke coil 1 and the capacitor 102 define a resonant circuit. A resonant frequency of this resonant circuit may be included in the frequency range of the common mode noises N generated by the noise generator 120. Under such a circumstance, the common mode noises N at this resonant frequency and in a frequency band near the resonant frequency are not sufficiently suppressed and the differential signals S3 and S3', on which the common mode noises N are superposed, may be output.

However, the magnetic lines of force H are configured to always pass through the metal film 6, as shown in FIG. 4, by providing the metal film 6 on the lower surface 5*b* and the side surface 5*c* of the top plate 5 in the common mode choke coil 1 of this preferred embodiment. Accordingly, a resistance component R against the common mode noises N at the above-described resonant frequency and in the frequency band near the resonant frequency increases, and this resistance component suppresses the common mode noises N. As a result, the common mode choke coil demonstrates a preferable noise suppression effect against the common mode noises N in all frequency bands that are used in the immunity test.

To confirm the advantages of preferred embodiments of the present invention, the inventors performed the following experiment.

In this experiment, an immunity test targeting, for example, a case in which the common mode choke coil 1 is provided in the FlexRay, which is used as a network of cables in a automobile, was performed to check how much the resistance component of the common mode choke coil changes depending on existence or absence of the metal film 6.

Figure 8:
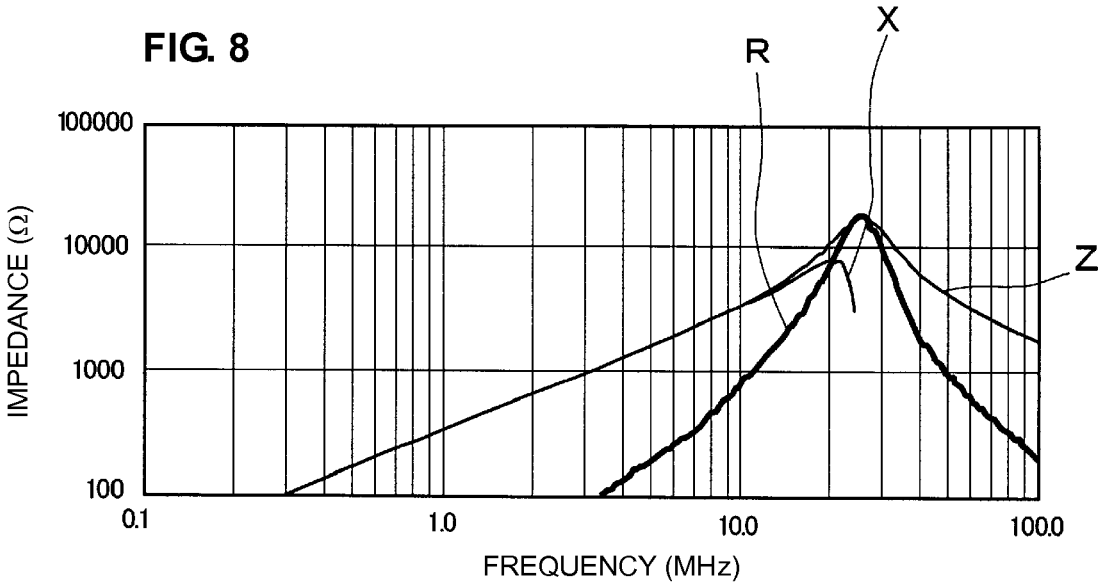
FIG. 8 is a diagram of a correlation between a frequency and impedance when a metal film is not provided.
Figure 9:
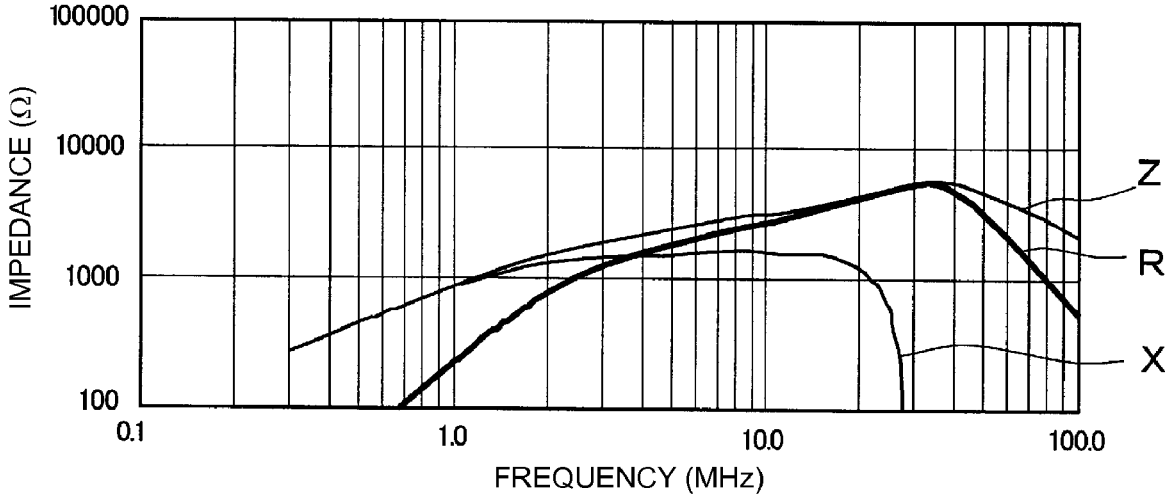
FIG. 9 is a diagram of a correlation between a frequency and impedance when a metal film is provided.

FIG. 8 is a diagram of a correlation between a frequency and impedance when the metal film 6 is not provided, and FIG. 9 is a diagram of a correlation between a frequency and impedance when the metal film 6 is provided.

First, a common mode choke coil having a size of 4532 (the length and width thereof are about 4.5 mm and about 3.2 mm, respectively) including the windings 4-1 and 4-2 of about 100 μH and the top plate 5 having the thickness of about 0.8 mm was disposed on the differential transmission paths 111 and 112 shown in FIG. 7. The experiment was performed by generating common mode noises N in a range of about 1 MHz to about 400 MHz with the noise generator 120. The capacitance of the capacitor 102 was about 10 pF to about 20 pF.

In FIG. 8, a curve R shows a resistance component of the common mode choke coil.

In this experiment, as shown by the curve R in FIG. 8, the resistance component R has a maximum value at a frequency of about 25 MHz and is very small in a frequency band of about 1 MHz to about 10 MHz.

On the other hand, an inductance value of the common mode choke coil 1 is about 100 μH and the capacitance of the capacitor 102 is about 10 pF to about 20 pF. Thus, the resonant frequency of the resonant circuit defined by the common mode choke coil 1 and the capacitor 102 of the reception IC 101 is several MHz.

Accordingly, if the common mode noises N of this resonant frequency and frequencies near the resonant frequency are superposed on the differential signals, the common mode choke coil used in this experiment cannot sufficiently suppress the common mode noises N since the resistance component is very small, due to which the reception IC 101 malfunctions.

The metal film 6 made of an alloy including nichrome (NiCr) as its main component was then formed on the lower surface 5*b* and the side surface 5*c* of the top plate 5 of the above-described common mode choke coil by metal plating or other suitable method, for example. After disposing the metal-film-6-including common mode choke coil 1 on the differential transmission paths 111 and 112 shown in FIG. 7, the common mode noises N in a range of about 1 MHz to about 400 MHz were generated by the noise generator 120.

In FIG. 9, a curve R shows a resistance component of the common mode choke coil.

In this experiment, as shown by the curve R in FIG. 9, the resistance component R in a frequency band of about 1 MHz to about 10 MHz is approximately equal to 1000Ω and the resistance component is sufficiently large over a wide frequency range thanks to the metal film 6.

Accordingly, if the common mode noises N of the resonant frequency of several MHz and of frequencies near the resonant frequency are superposed on the differential signals, the large resistance component resulting from the metal film 6 suppresses the common mode noises N. Thus, the reception IC 101 does not malfunction.

Second Preferred Embodiment

Figure 10:
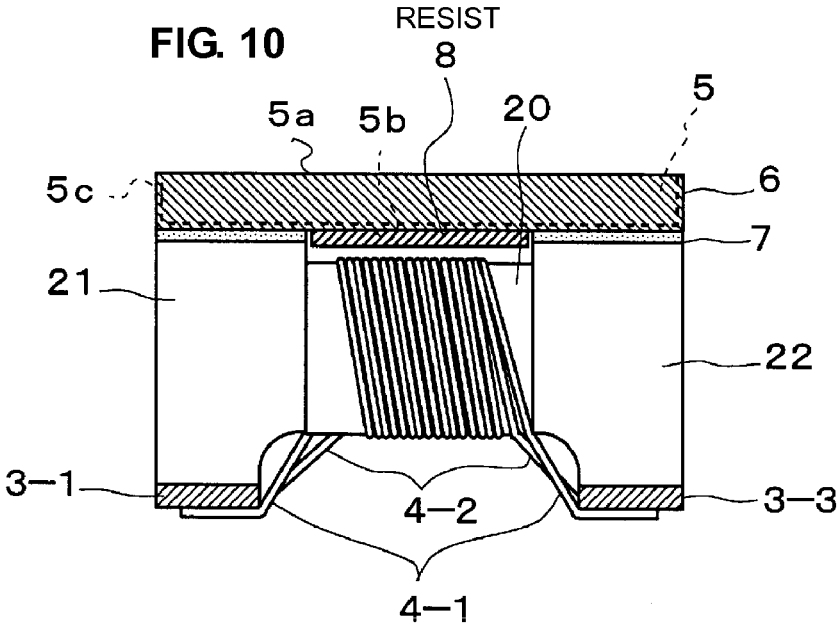
FIG. 10 is a sectional view showing a common mode choke coil according to a second preferred embodiment of the present invention.
Figure 11A:
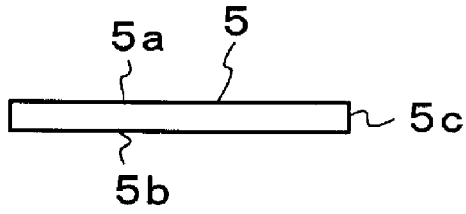
FIG. 11A to 11C show a lateral view of a process for manufacturing a top plate of a common mode choke coil according to the second preferred embodiment of the present invention.
Figure 11B:
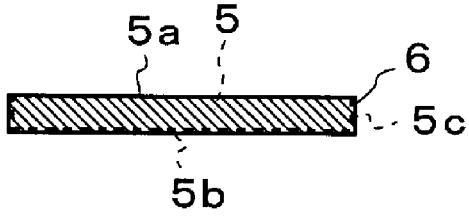
Figure 11C:
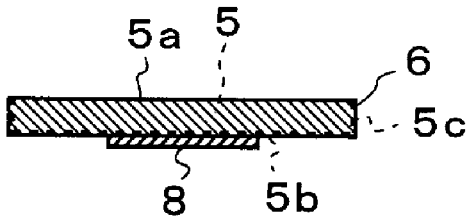

FIG. 10 is a sectional view showing a common mode choke coil according to a second preferred embodiment of the present invention, whereas FIGS. 11A to 11C are lateral views showing a process of manufacturing a top plate of the common mode choke coil of this preferred embodiment.

As shown in FIG. 10, the common mode choke coil of this preferred embodiment differs from that of the first preferred embodiment in that a resist 8 is provided below the top plate 5.

This resist 8 is made of, for example, an epoxy based resin and is provided on a lower surface of a metal film 6 covering the top plate 5 to face windings 4-1 and 4-2.

Manufacture of the top plate 5 having such a resist 8 is performed as shown in FIGS. 11A to 11C.

More specifically, the top plate 5 is formed as shown in FIG. 11A. The metal film 6 is then formed on a lower surface 5*b* and a side surface 5*c* of this top plate 5 in accordance with a method, such as metal plating, for example, as shown in FIG. 11B. After a predetermined time, the resist 8 is applied to a portion of the lower surface 5*b* of the top plate 5 as shown in FIG. 11C.

If an electrostatic test is performed on the common mode choke coil, static electricity flowing through the windings 4-1 and 4-2 may be discharged toward the metal film 6 of the top plate 5 and may possibly destroy the coating of the windings 4-1 and 4-2. However, by providing the resist 8 on a surface of the metal film 6 facing the windings 4-1 and 4-2 as in this preferred embodiment, it is possible to increase a withstand voltage between the windings 4-1 and 4-2 and the metal film 6. As a result, electrostatic test performance can be improved.

Since other configurations, effects, and advantages are substantially the same as those of the first preferred embodiment, a description thereof is omitted.

Third Preferred Embodiment

Figure 12:
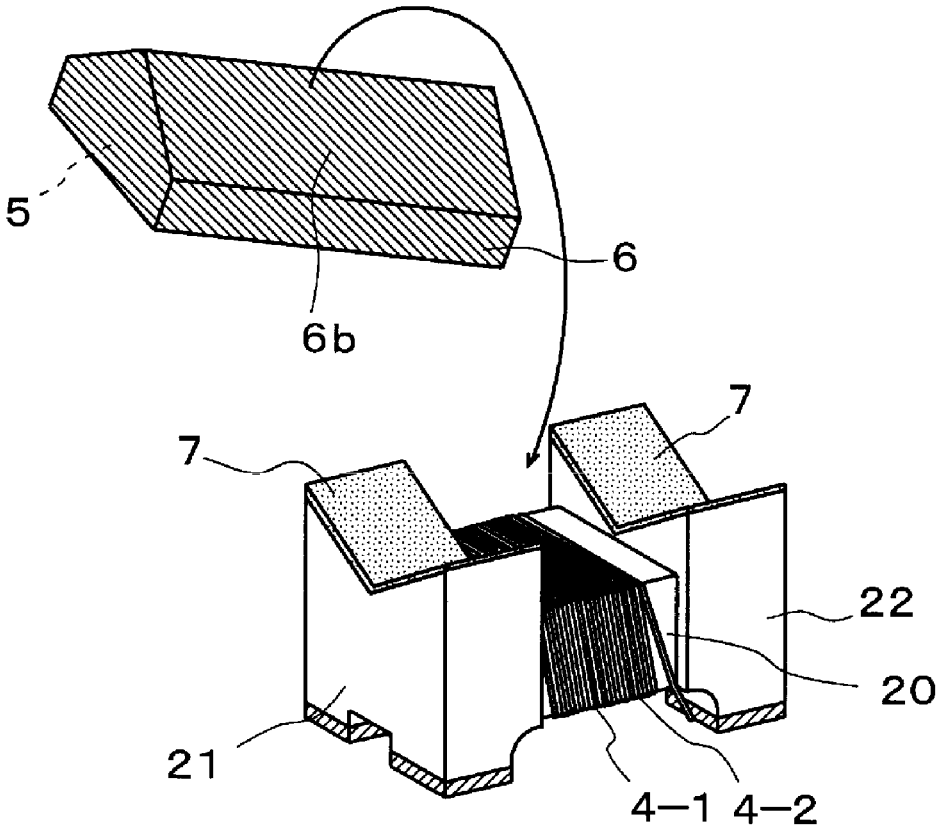
FIG. 12 shows an exploded perspective view showing a common mode choke coil according to a third preferred embodiment of the present invention.
Figure 13:
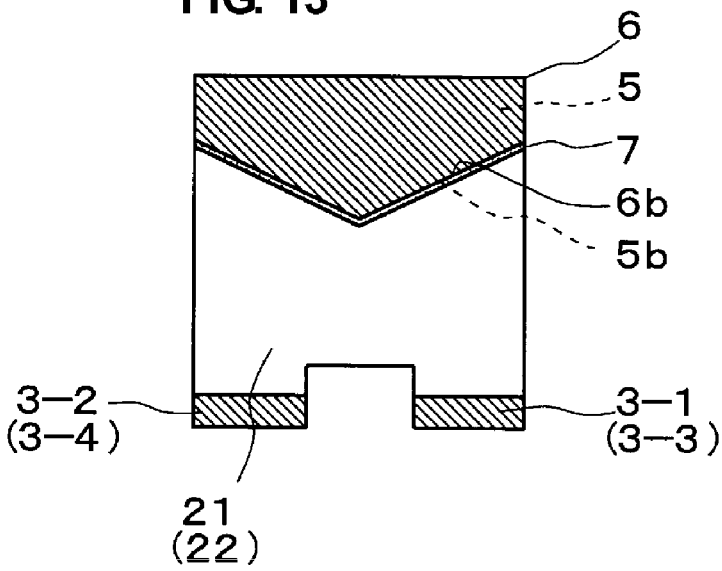
FIG. 13 is an elevational view of a common mode choke coil according to the third preferred embodiment of the present invention.

FIG. 12 is an exploded perspective view showing a common mode choke coil according to a third preferred embodiment of the present invention, and FIG. 13 is an elevational view of the common mode choke coil of this preferred embodiment.

As shown in FIG. 12, the common mode choke coil of this preferred embodiment differs from those of the first and second preferred embodiments in that a size of a contact portion of a metal film 6 contacting flanges 21 and 22 is increased.

More specifically, as shown in FIG. 13, a lower surface 5*b* of a top plate 5 has a substantial chevron shape and the metal film 6 is provided over substantially the entire lower surface 5*b*. Accordingly, a lower surface 6*b* of the metal film 6 also has a substantial chevron shape, i.e., a cross section thereof has a substantial V-shape.

Since the lower surface of the top plate 5 and the upper surface of the flange 21 (22) are configured as substantially horizontal surfaces in the first and second preferred embodiments, a contact portion of the metal film 6 contacting the upper surface of the flange 21 (22) forms a substantially horizontal surface. However, as described above, since the lower surface 5*b* of the top plate 5 and an upper surface 21*c* (22*c*) of the flange 21 (22) have substantial V-shaped cross sections in this preferred embodiment, the contact portion of the lower surface 6*b* of the metal film 6 contacting the upper surface of the flange 21 (22) also have a substantial V-shaped cross section. Accordingly, the size of the contact portion is preferably increased as compared to the first and second preferred embodiments.

With such a configuration, a resistance component of the metal film 6 is increased. As a result, the common mode choke coil provides a more preferable noise suppression effect against common mode noises in an immunity test.

Meanwhile, the specific arrangement for increasing the size of the contact portion of the metal film 6 contacting the flanges 21 and 22 is not limited to the configuration shown in FIG. 12 and FIG. 13.

Figure 14:
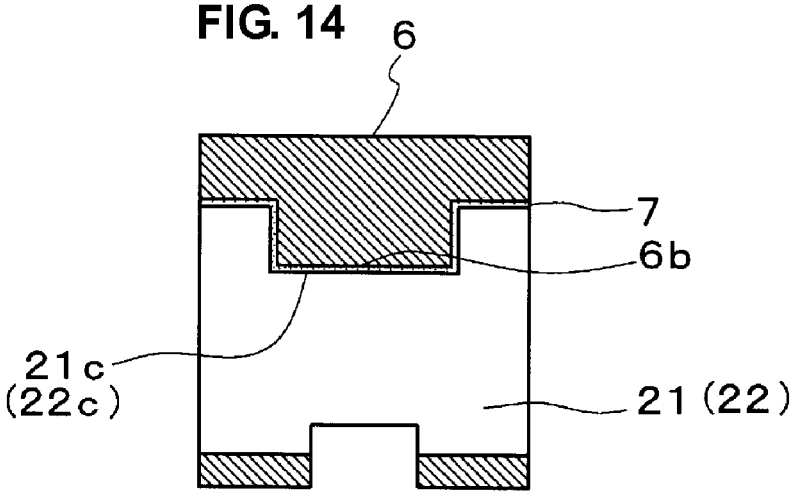
FIG. 14 is an elevational view showing a first modified example of the third preferred embodiment of the present invention.
Figure 15:
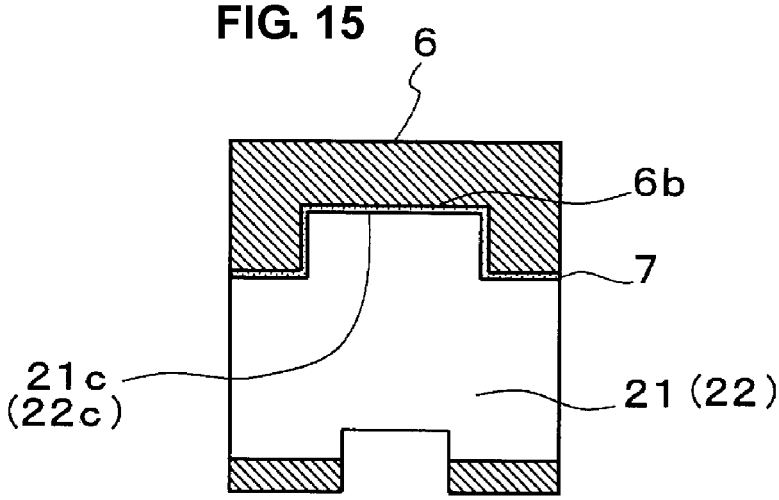
FIG. 15 is an elevational view showing a second modified example of the third preferred embodiment of the present invention.
Figure 16:
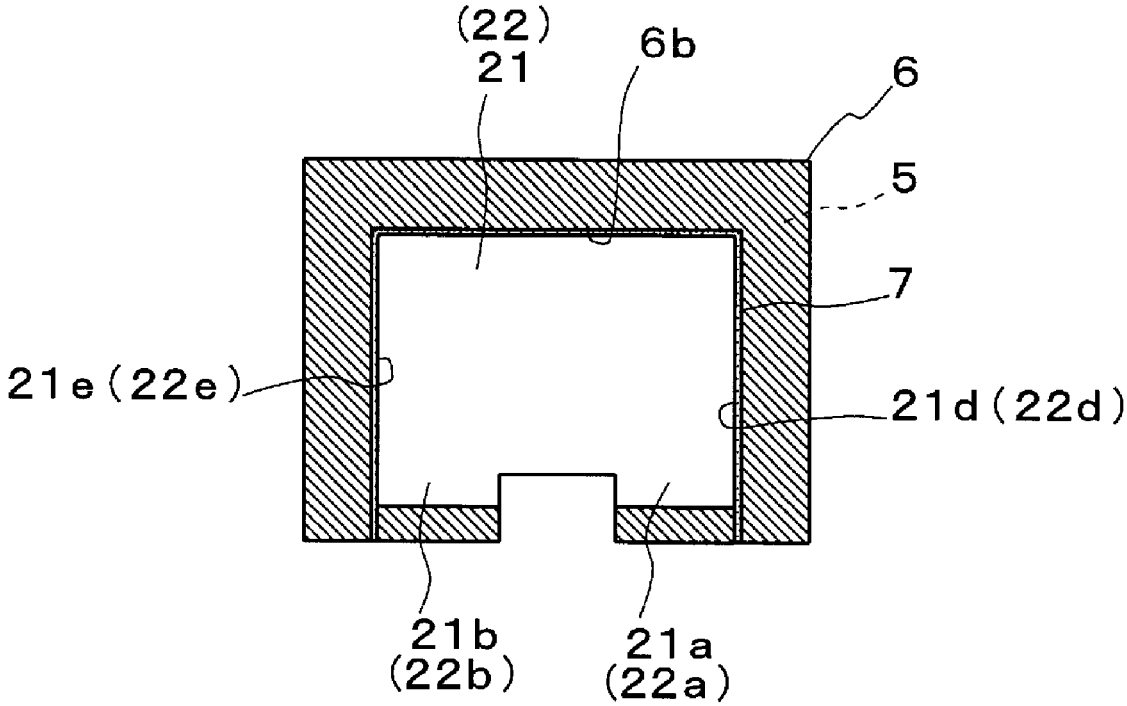
FIG. 16 is an elevational view showing a third modified example of the third preferred embodiment of the present invention.

FIG. 14 is an elevational view showing a first modified example of the third preferred embodiment. FIG. 15 is an elevational view showing a second modified example of the third preferred embodiment. FIG. 16 is an elevational view showing a third modified example of the third preferred embodiment.

More specifically, as shown in FIG. 14, a central portion of the lower surface 6*b* of the metal film 6 is projected so as to have a substantially U-shaped cross section and the upper surface 21*c* (22*c*) of the flange 21 (22) is also indented to correspond to the shape of the lower surface 6*b* of the metal film 6. In this manner, the size of the contact portion of the metal film 6 contacting the flanges 21 and 22 can also increased.

As shown in FIG. 15, by indenting the central portion of the lower surface 6*b* of the metal film 6 to have a substantially reversed U-shaped cross section and projecting the upper surface 21*c* (22*c*) of the flange 21 (22) to correspond to the shape of the lower surface 6*b* of the metal film 6, the size of the contact portion of the metal film 6 contacting the flanges 21 and 22 is increased.

In addition, as shown in FIG. 16, the entire or substantially the entire top plate 5 is configured to have a substantially reversed U-shape cross section and the metal film 6 is provided on the top plate 5. The lower surface 5*b* that is an inner side of the top plate 5, namely, the lower surface 6*b* of the metal film 6, is attached to the upper surface 21*c* (22*c*) and side surfaces 21*d* and 21*e* (22*d* and 22*e*) of the flange 21 (22) with the adhesive 7. Such a configuration also increases the size of the contact portion of the metal film 6 contacting the flanges 21 and 22.

Since other configurations, effects, and advantages are substantially the same as those of the first and second preferred embodiments, a description thereof is omitted.

Fourth Preferred Embodiment

Figure 17:
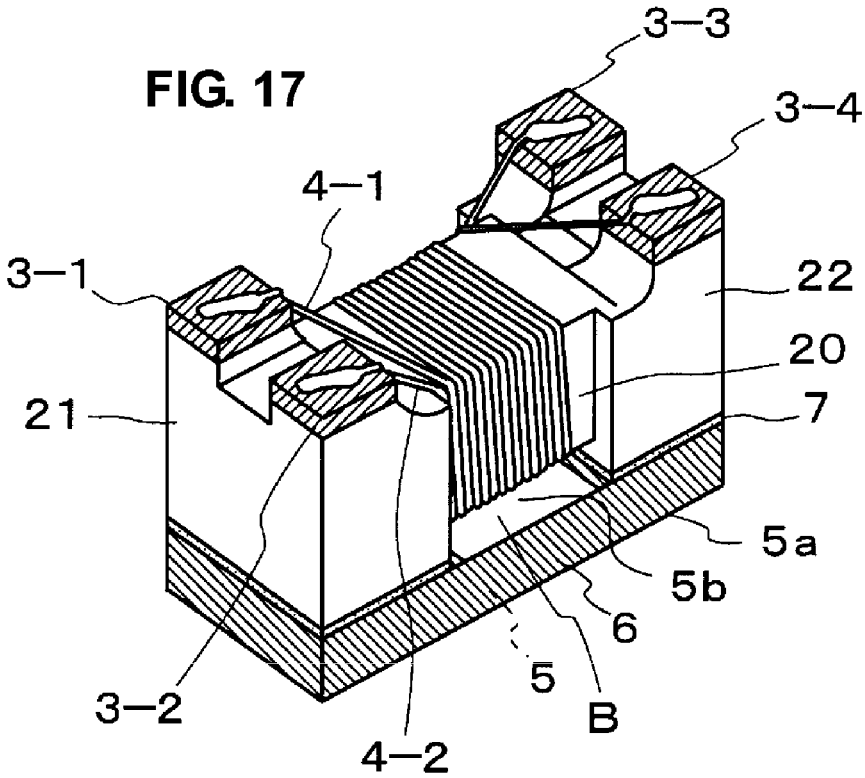
FIG. 17 is a perspective view showing a common mode choke coil according to a fourth preferred embodiment of the present invention upside down.
Figure 18:
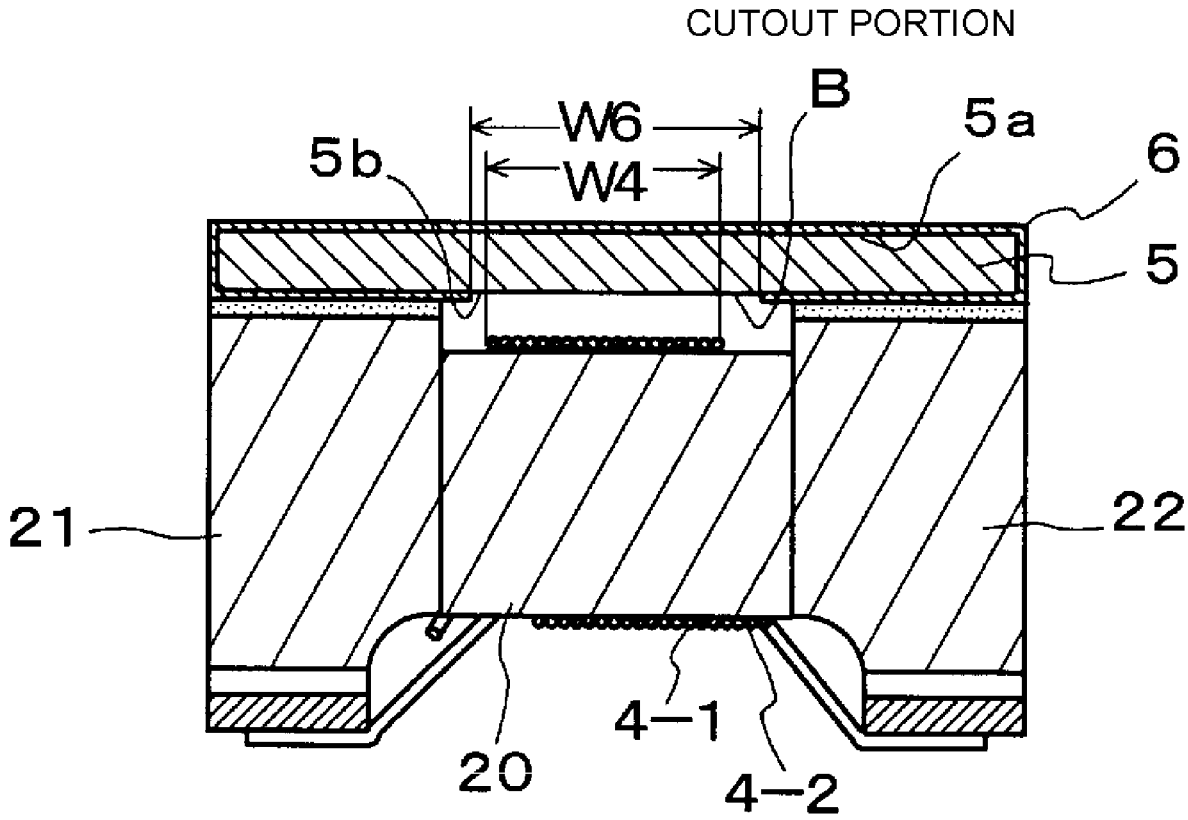
FIG. 18 is a sectional view of a common mode choke coil according to the fourth preferred embodiment of the present invention.

FIG. 17 is a perspective view showing a common mode choke coil according to a fourth preferred embodiment of the present invention that is arranged upside down, and FIG. 18 is a sectional view showing the common mode choke coil of this preferred embodiment.

As shown in FIG. 17, the common mode choke coil of this preferred embodiment differs from those of the first to third preferred embodiments in that a cutout portion B is provided at a lower portion of a metal film 6.

More specifically, as shown in FIG. 18, the metal film 6 is provided on an upper surface 5*a* of the top plate 5 and extends to portions of the lower surface 5*b* of the top plate 5. The cutout portion B is provided at a portion of the lower surface 5*b* of the top plate 5 on which the metal film 6 does not extend. A width of this cutout portion B (in a front-back direction in FIG. 18) is set to be substantially equal to a width of the top plate 5, and a length W6 thereof (in a left-right direction in FIG. 18) is set to be substantially equal to or greater than a winding length W4 of the windings 4-1 and 4-2.

Even if static electricity flowing through the windings 4-1 and 4-2 is produced at the time of an electrostatic test of the common mode choke coil, such a configuration prevents a phenomenon in which the static electricity discharges toward the metal film 6 since a metal film portion receiving the static electricity does not exist.

Since other configurations, effects, and advantages are substantially the same as those of the first to third preferred embodiments, a description thereof is omitted.

The present invention is not limited to the above-described preferred embodiments and can be variously altered and modified within a scope of the spirit of the invention.

For example, although the core 2 and the top plate 5 are preferably made of ferrite in the above-described preferred embodiments, it is not intended that common mode choke coils in which these members are made of magnetic materials other than ferrite are excluded from the scope of the invention.

Furthermore, although an example of mixing magnetic powder in the adhesive 7 is shown in the above-described preferred embodiments, it is not intended that common mode choke coils in which a magnetic-powder-free adhesive is used are excluded from the scope of this invention.

Moreover, although the external electrodes 3-1 to 3-4 are directly provided on the flanges 21 and 22 of the core 2 in the above-described preferred embodiments, it is not intended that other preferred embodiments, e.g., common mode choke coils in which external electrodes are provided at the flanges 21 and 22 using metal terminals, are excluded from the scope of this invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A common mode choke coil comprising:

a magnetic core having a winding core portion and a pair of flanges provided at respective ends of the winding core portion;

external electrodes provided on the respective flanges;

a pair of windings wound around the winding core portion, each end of the pair of the windings being extended and connected to the external electrodes; and a magnetic plate attached to the pair of the flanges; wherein a metal film is arranged at least on a contact portion of the magnetic plate contacting the flanges; and the metal film and the external electrodes are not electrically connected.

2. The common mode choke coil according to claim 1, wherein the magnetic core and the magnetic plate are made of ferrite.

3. The common mode choke coil according to claim 1, wherein the metal film is made of a ferromagnetic material including at least one of iron, cobalt, nickel, chromium, manganese, and copper.

4. The common mode choke coil according to claim 3, wherein the metal film is made of an alloy of ferromagnetic materials including nichrome as a main component.

5. The common mode choke coil according to claim 1, wherein the magnetic plate is attached to the pair of the flanges with an adhesive magnetic and powder is mixed in the adhesive.

* * * * *